United States Patent [19]

Dassler et al.

[11] Patent Number: 4,579,495

[45] Date of Patent: Apr. 1, 1986

[54] ENVIRONMENTAL RETAINED TAB ENDS

[75] Inventors: Karl O. Dassler, Algonquin; Neal E. Langseder, Rolling Meadows, both of Ill.

[73] Assignee: American Can Company, Greenwich, Conn.

[21] Appl. No.: 337,955

[22] Filed: Jan. 8, 1982

[51] Int. Cl.[4] ..... B21D 51/00

[52] U.S. Cl. ..... 413/15; 413/17; 413/67

[58] Field of Search ..... 413/17, 15, 67; 220/265–268; 72/324, 330, 335, 336, 338, 339; 225/2, 96, 96.5

[56] References Cited

U.S. PATENT DOCUMENTS

| | | | |
|---|---|---|---|
| 3,788,118 | 1/1974 | Joseph | 72/330 |
| 3,870,001 | 3/1975 | Brown | 413/17 |
| 4,154,184 | 5/1979 | Keller et al. | 220/268 |
| 4,348,464 | 9/1982 | Khoury | 72/324 |
| 4,354,784 | 10/1982 | Westphal | 413/67 |

*Primary Examiner*—Leon Gilden

*Attorney, Agent, or Firm*—Paul R. Audet

[57] ABSTRACT

This invention relates in general to new and useful improvements to easy opening container ends. More particularly, it relates to a new improved method of forming a hinged connection between a tab and an end panel.

8 Claims, 5 Drawing Figures

ENVIRONMENTAL RETAINED TAB ENDS

BACKGROUND OF THE DISCLOSURE

In the early 1960's metal container end technology was advanced by the development of easy opening container closures. These closures function without need for special opener tools and are now well known in the art. For example, U.S. Pat. No. 2,723,778 describes an easy opening closure with a metallic reusable plug and U.S. Pat. No. 2,849,164 describes a container wherein the opening in the top of the container is covered by a thin strip or plate, the plate being held in position by engagement with a lip. The ready acceptance of easy-opening containers has resulted in extended use of this type container for a substantial number of canned products. The most popular type of closure has a removable or opening section defined by a score line and has a tab secured to the panel which can be manipulated to effect opening. These openings can be effectively used for food products where the entire end panel is removed to dispense the contents (an example would be U.S. Pat. No. 3,366,270) or for beverage products where only a small section of the end panel is displaced to allow dispensing by pouring, as in U.S. Pat. 3,967,752.

In normal can end closure design and manufacture, it is common practice to secure a tab to the end panel by means of a rivet, the rivet being formed from the end panel and the tab used to effect some sort of easy opening feature. The easy opening feature may be of the kind where the entire scored end panel is removed to dispense the contents of the can or only a portion of the scored end panel is displaced to allow dispensing by pouring the contents. In any case the majority of easy opening features make use of some sort of tab to effect the displacement of the scored portion of the end. There exist a wide variety of tab, designs for this purpose. The most common and preferred of which have a tongue portion of the tab surrounding the rivet cut out from the tab itself, the cut terminating near the forward or nose portion of the tab so as to create a hinge. The cut allows for easy lifting of the tab to effect opening. The hinge exists along a transverse line near the termination of the cut portion. The cut portion is rigidly secured to the end panel so as to permit swinging of the tab relative to the panel about the hinge line to effect an opening pressure on the panel.

One disadvantage of this type of tab is in the formation of the cut portion. The cut portion is usually sheared completely through with a punch and matching die cut edge. These cut edges require close clearances usually within a maximum of 0.0025" depending on the stock thickness so that the cut can be made without excess burr. The corners on the cut edges must be maintained sharp to provide a good cut. In addition, the die cut edge usually requires a spring loaded ejector to remove the cut portion. All of these features of normal tab tongue formation are disadvantageous. There exist common problems with tolerances and alignment which increase the cost of tooling. The ejectors can malfunction and cause jams which hamper efficiencies and speeds. The cut edges become dull which will result in lost tab strength. Problems in maintaining the tooling arise particularly when cutting aluminum because the edge of the tool requires sharpening as it becomes blunted. Cutting the rivet island or tongue does not provide the optimum cut condition to ensure tab resistance to tearing. Even with sharp cutters it is impossible to completely eliminate burrs. These burrs are indicative of an unclean cut or a cut which leaves a jagged edge at the sheared portion. A characteristic of this jagged edge is increased stress risers which increase the tendency for a tear to propagate across the cut portion when the cut is placed in shear on opening. This tendency to promote tear propagation is detrimental to tab strength and worsens as the cutters dull.

In particular, this invention relates to a method of forming a hinged connection between the tab and end panel where the tab has increased resistance to tearing, thus permitting the use of lighter gauge or weaker alloy, lower cost tab stock. The implications of being able to use lower cost material for end manufacture are evident when one considers the billions of ends manufactured annually. The savings can significantly improve the profitability of containers in a very competitive market. A major part of many cost reduction efforts is aimed at increasing product strength so that less material can be used. This invention accomplishes this goal. In addition, to allowing the advantage of lighter gauge tab stock this invention will also permit the use of softer alloy tab stock without loss of tab strength. Softer alloys are often used in manufacture of environmental or retained tab ends because they allow the tab to withstand repeated bending without detachment from the end panel.

OBJECTS OF THE DISCLOSURE

An object of the present invention is to improve the formation of this hinged connection particularly near the termination of the cut.

Another object of the present invention is to overcome the type of stress referred to when cutting or shearing the rivet island. The jagged edge and subsequent stress risers which result from shearing can be eliminated by the preferred scoring method.

Another object is achieved by scoring the cut rather than shearing it completely through and then subsequently breaking the score so as to provide the cut portion terminations for an easy lift tab. The score operation provides several beneficial effects which enable the tab to resist tearing.

A further object of this invention is to simplify the tab die tooling used in conventional practice to cut the hinge portion from the tab.

SUMMARY OF THE DISCLOSURE

The scoring establishes a predetermined thinned section of material surrounding the rivet. The material from this thinned section is displaced by the swaging action of the wedge shaped score cutter so as to mound the material up on the adjacent sides or banks of the thinned section. Thus, the portions bordering the cut which most likely would be subject to tearing are in effect thicker in cross section and less likely to tear. In addition to the effect of increased thickness, the scored section is work hardened by the swaging which increases its resistance to transverse tearing. Similarly, the grain boundary and grain orientation of the tab material in the area of the scored section are also preferentially distorted which increases the resistance to transverse tearing. Finally, the edges of the scored area take on the finish of the scoring tool which can be controlled with a very fine polishing. That finish also increases the tab resistance to transverse tearing by eliminating stress risers.

Conventional die tooling designs requires matching male and female punch and die members with close tolerances to allow them to engage and shear the material. Such designs also require the use of spring loaded strippers and shedders to eject the tab from the cutting members. The present invention requires only solid punch and die members one of which is flat and the other of which contains the profile of the score which can be easily made on a tool using modern EDM techniques. The use of a score also has the advantage of allowing any possible profile or configuration of the tab tongue because of the wide versatility in EDM techniques which permit nearly any profile that can be laid out to be made.

DETAILED DESCRIPTION OF THE DISCLOSURE

Tabs are used in connection with the opening features for a variety of different container ends and more specifically containers which need only a small opening for beverage or other liquid dispensing as well as tabs which are used to provide a full panel opening feature. Many of these tab arrangements are riveted to the central panel of a double seamed metal container end. The rivet provides the connection to the panel such that the tab may be used in a lever fashion to break, tear and remove or bend an opening in the end. The opening is usually predefined by a score line wherein the thickness of the panel is decreased along a preset path to define a line of weakness as a border about the opening. It is common also to provide a preferential slit portion in the center of the tab to encourage and facilitate the movement of the tab relative to the end panel. Such a slit will form an island of material which stays riveted against the end panel and will define a hinging axis about which the tab can be swung to facilitate the lever action. More specifically one end of the tab is provided for grasping by the user and the opposite end of the tab generally contacts and breaks loose the portion of the central panel to be opened. The rivet and rivet island are disposed between the worked and working ends of the tab. It is important to appreciate that the strength of the tab connection to the rivet is a function of the configuration of the rivet island and the slit defining same as well as the material used to form the island in the area of the hinge.

Figure 1:
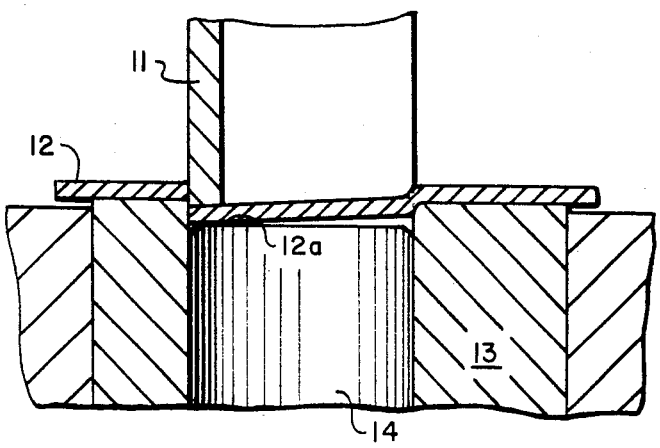
PRIOR ART FIG.1
FIG. 1 is a partial side cross sectional view of the tool area the prior art which is used to split the rivet island in a progressive forming operation for a tab.

FIG. 1 shows the way in which the rivet island has heretofore been sheared in a conventional punch and die arrangement. more specifically, in FIG. 1, there is provided a punch 11 which is adapted to shear the tab stock 12 against a die 13 in order to cut the slit that defines the rivet island. Beneath the sheared rivet island 12*a* is shown a die cut edge shedder 14 which is spring loaded (spring not shown) to exert supporting force against the sheared rivet island 12*a*. The forming operation is conventional and leaves the sheared rivet island at approximately a 30° angle with respect to the plane of the tab stock 12. Such a shearing operation could take place in a tab forming progression as shown in FIG. 5 wherein the operation of shearing the rivet island slit 15 could take place prior to the drawing operation in which the tab body 16 is first defined.

Figure 5:
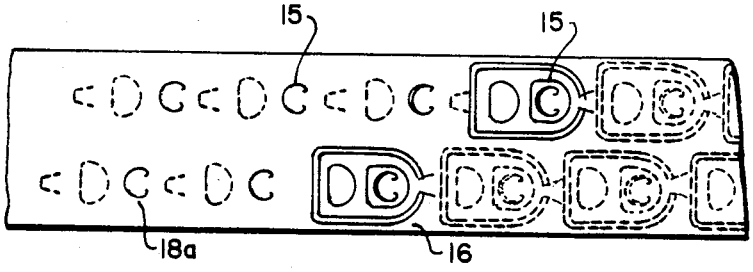
FIG. 5 is a portion of the progression which is made to form an end opening tab and more particularly the portion during which the scoring and then tearing of the rivet island can take place in the process where the preferred metal forming tooling is used.

FIG. 5 shows only a portion of the progression which is relevant to the present disclosure and operations and associated tooling therein will be used to explain how the progression is applied in the preferred technique herein disclosed and claimed. That is to say that, those skilled in the art will no doubt appreciate how the prior art progression varied from the conventional shearing operation to the presently disclosed improved rivet island severing operations.

Figure 2:
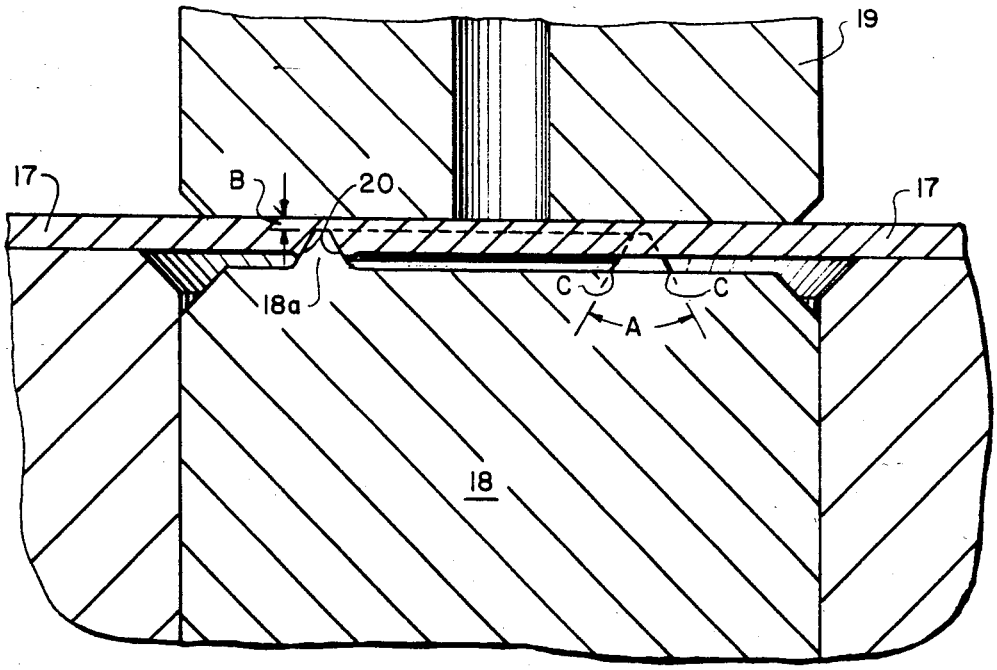
FIG. 2 is a partial side cross sectional view of the tooling used in the present improvement to score the rivet island and work the metal adjacent the score.

Turning now to FIG. 2 wherein the first step of the process of the improvement is shown in a partial side cross sectional view of the tooling. The tab stock 17 is disposed in a horizontal plane between a scoring punch 18 and a scoring anvil 19. More particularly, the score punch 18 includes an upstanding scoring tool 18*a* which is arranged to provide a scored portion on the tab stock 17 in the shape of the rivet island slit 15 as depicted in connection with FIG. 5. More specifically, the scoring tool 18*a* displaces the tab stock material 17 to define a wedge-shaped groove having a flat bottom. In the preferred embodiment the groove extends into the material of the tab stock 17 as much as 90% of the total thickness of the material. The exact configuration of the tool 18*a* has an included angle "A" of 60° with a blunt 0.003" flat where the apex would be. The preferred stock thickness is 0.018" and the preferred depth of the score is such that the residual thickness after scoring indicated at "B" in FIG. 2 is about 0.003".

The drawings have not been made to scale. The preferred tab material is metal, for example the softer alloy 5082-H251 aluminum can now be used instead of the harder 5182-H19 to provide a tab for a stay-on tab type environmental beverage end. That softer tab stock has greater fatigue strength even though the gauge is reduced and more importantly the initial strength required to rupture the opening is adequate because the edges of the rivet island slit 15 have been specifically formed. Similarly, a steel tab could be fashioned or a full panel opening tab could acceptably be formed as hereafter explained. Continuing with FIG. 2, there is a definite change in the structure of the tab stock thickness due to the scoring operation and, more specifically the surface of the stock adjacent the sides of the score groove is upset outwardly from the bottom of the groove at "C" due to the working of the metal during scoring. Similarly, the surface of the metal along the walls of the score 20 is work hardened such that the metal grain is not cut but has been compressed to form a grain structure which tends to be parallel to the configuration of the groove score wall. It is known that such working of the metal tends to enhance resistance of the metal along the walls and across the bottom of the score to transverse tearing. This coupled with the displacement of the metal upwardly at "C" acts to enhance the overall tearing or shear strength across the groove or scored portion of the tab.

Figure 3:
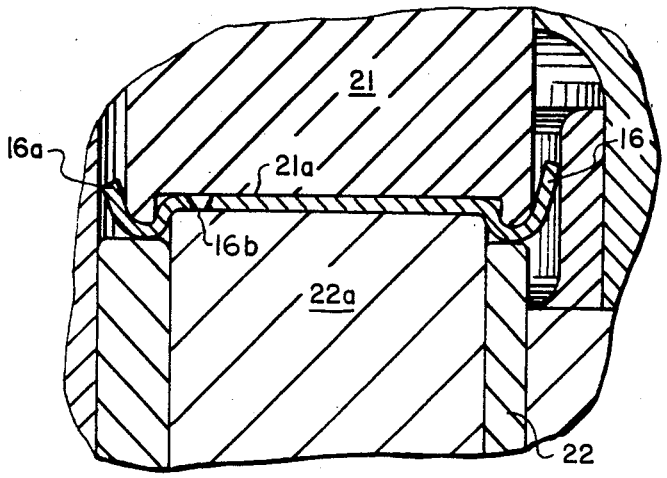
FIG. 3 is a partial side cross sectional view of an operation subsequent to that shown in FIG. 2 wherein the tooling stretches the tab stock to slit the residual portion or thickness of the metal left beneath the scoring.
Figure 4:
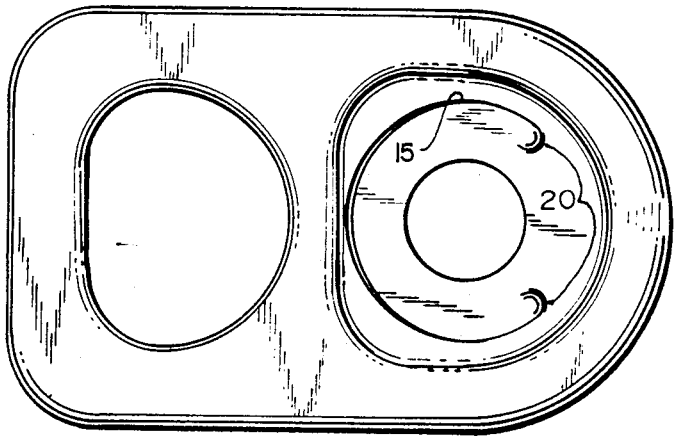
FIG. 4 is a plan view of a typical end opening tab showing the area which is scored and then torn to form the rivet island.

FIG. 3 shows subsequently the operation of FIG. 2 and more specifically, the progressive forming of the tab body 16 is shown in FIG. 5. The tab body 16 is being formed by a die 21 and an associated punch 22 which as they come together tend to curl the edges of the tab stock 17 and at the same time stretch the center of the tab body 16. During the paneling (Deboss) operation, the scored rivet island 18*a* is put in tension and more specifically the residual area "B" shown in FIG. 2 is torn at 16*b* due to the loading imposed by the punch 22 and die 21 of FIG. 2. The punch 22 has a tab body center panel forming portion 22*a* which presses that panel against a recess 21*a* in the die 21. The portion 22*a* has a slight curvature outwardly such that the panel metal is stretched over that curved surface of portion 22*a*.

Thus, the walls 20 of the score 18*a* remain pretty much as they were after scoring. Those walls 20 retain their preferred work hardened grain structure and yet the rivet island slit has been made by tearing the residual portion which is relatively a small percentage of the overall structure thickness. It has been found that with relatively small changes have been made to the typical tooling used to form the tab body 16 sufficient tension can be placed across the residual "B" of the score 18*a* to cause the island slit to form by tearing. It is known that the performance of the scored and torn rivet island slit is superior to the sheared slit in that the remaining edges composed of walls 20 and the torn residual "B" have greater resistance to transverse tearing than a sheared slit and thus the hinge line ultimately defined by the rivet island during use has greater strength even though the force required to initially activate the tab is about the same.

It is surprising to find that an unconventional metal forming operation will produce superior end products and more specifically that a 2-step operation, one of which is uncontrolled tearing, will give a stronger overall structure from the point of view of the initial opening force capability required to rupture the panel to be opened. More particularly, the rupture force being the greatest stress which the tab must withstand limits the choice of its material strength and its gauge reduction. By using the improved island slit forming technique herein, a tab can be made from a minimum material strength. In addition, the cyclic fatigue failure of tabs during use is due to multiple bending cycles about the hinge line which causes the tab to become progressively weaker and results in a tear across the hinge line permits the tab to be removed from the rivet island. Removal of the tab from an environmental end is a very undesirable result. Consequently, the present improved slit forming technique is helpful in resisting fatigue because now softer alloys can be used without concern for failure due to initial rupture loading.

While a specific arrangement has been described, overall dimensions have been alluded to and a particular material has been suggested. The invention in its broadest interpretation is to a means for forming a preferred line of weakness in any kind of a part wherein the edges or walls of a slit define the line of weakness where the preferred structure is made by the disclosed technique used to form the rivet island slit for an environmental tab. It is believed that this approach has broad application for not only the manufacture of beverage tabs but also in connection with any metal cutting process where the strength across the edge is important. The claims which follow seek to cover the overall concept.

What is claimed is:

1. A method of forming a line of separation to partially define a rivet island on a substantially planar portion of a thin metal opening tab to be attached to a container end for relative movement between the tab portions, comprising the steps of:

working the metal by reducing the thickness thereof by at least one-half to define a line of weakness, effecting said working with tooling having a blunt distal surface and tapered walls on either side thereof by impressing said tooling into said tab thereby to (1) form a blunt V-groove, (2) displace metal from said groove along either side thereof to increase the tab thickness therealong, and (3) work harden and grain orient the walls of said groove by said tool walls to form fatigue hardened resistant edges thereat, and, rupturing the residual metal of said tab at the bottom of the groove, thereby to define said line of separation, whereby the fatigue hardened edges along and at the ends of said line of separation are resistant to tearing and rupture resulting from flexure of the major portion of said tab relative to said rivet island during utilization of said tab in opening a container.

2. The method of claim 1 wherein said working is effected along an arcuate line, and wherein said in-use flexure occurs at either end thereof.

3. The method of claim 1 wherein said working step includes compressing said tab between said tooling and a planar anvil.

4. The method of claim 1 wherein said rupturing is effected by stretching said tab on either side of said groove.

5. The method of claim 1 including providing said tooling with tapered walls having an angle therebetween on the order of 60°.

6. The method of claim 1 wherein the step of working the tab includes reducing the thickness thereof on the order of 80% of the original thickness, thereby to enhance the work hardening and grain orientation of the groove walls, and its resistance to tearing.

7. The method of claim 1 wherein the tab is an aluminum tab.

8. The method of claim 1 wherein the tab is a steel tab.

* * * * *